US008517295B2

(12) United States Patent
Matsuzaki et al.

(10) Patent No.: US 8,517,295 B2
(45) Date of Patent: Aug. 27, 2013

(54) APPARATUS FOR FRACTURING POLYCRYSTALLINE SILICON AND METHOD FOR PRODUCING FRACTURED FRAGMENTS OF POLYCRYSTALLINE SILICON

(75) Inventors: Takahiro Matsuzaki, Naka-gun (JP); Teruyoshi Komura, Naka-gun (JP); Shunsuke Kotaki, Naka-gun (JP); Motoki Sato, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 13/282,704

(22) Filed: Oct. 27, 2011

(65) Prior Publication Data

US 2012/0104127 A1 May 3, 2012

(30) Foreign Application Priority Data

Oct. 28, 2010 (JP) ..... 2010-242059

(51) Int. Cl.
*B02C 13/20* (2006.01)
*B02C 13/09* (2006.01)

(52) U.S. Cl.
USPC ..... 241/187; 241/189.1; 241/294

(58) Field of Classification Search
USPC ..... 241/187, 294, 189.1
See application file for complete search history.

(56) References Cited

U.S. PATENT DOCUMENTS

| | | | | |
|---|---|---|---|---|
| 2,626,128 | A * | 1/1953 | Boice | 175/374 |
| 2,687,875 | A * | 8/1954 | Scott et al. | 175/374 |
| 3,153,511 | A * | 10/1964 | Atack et al. | 241/38 |
| 3,434,672 | A * | 3/1969 | Guin | 241/194 |
| 5,377,919 | A * | 1/1995 | Rogers et al. | 241/189.2 |
| 6,953,166 | B2 * | 10/2005 | Schenk | 241/79 |
| 2006/0070569 | A1 | 4/2006 | Andrejewski et al. | |
| 2006/0088970 | A1 | 4/2006 | Hesse et al. | |
| 2009/0114748 | A1 | 5/2009 | Gruebl et al. | |
| 2012/0048976 | A1 * | 3/2012 | Hofmann et al. | 241/230 |

FOREIGN PATENT DOCUMENTS

| | | | |
|---|---|---|---|
| JP | 2006-122902 | A | 5/2006 |
| JP | 2006-192423 | A | 7/2006 |
| JP | 2009-531172 | A | 9/2009 |

* cited by examiner

*Primary Examiner* — Faye Francis
(74) *Attorney, Agent, or Firm* — Edwards Wildman Palmer LLP

(57) ABSTRACT

An apparatus for fracturing polycrystalline silicon having a pair of rolls which are rotated in a counter direction each other around parallel axes; and a plurality of fracturing teeth which are provided on outer peripheral surfaces of the rolls and are protruded radially-outwardly, in which top surfaces thereof are formed spherically and side surfaces thereof are formed conically or cylindrically, and fracturing fragments of polycrystalline silicon between the rolls.

6 Claims, 9 Drawing Sheets

APPARATUS FOR FRACTURING POLYCRYSTALLINE SILICON AND METHOD FOR PRODUCING FRACTURED FRAGMENTS OF POLYCRYSTALLINE SILICON

CROSS REFERENCE TO RELATED APPLICATIONS

This application is related to four co-pending applications, all of them entitled, "APPARATUS FOR FRACTURING POLYCRYSTALLINE SILICON AND METHOD FOR PRODUCING FRACTURED FRAGMENTS OF POLYCRYSTALLINE SILICON" filed concurrently herewith as follows: in the names of Ryusuke Tada and Motoki Sato which claims priority to Japanese Patent Application No. 2010-242063 filed Oct. 28, 2010; in the names of Ryusuke Tada and Motoki Sato which claims priority to Japanese Patent Application No. 2010-242062 filed Oct. 28, 2010; in the names of Ryusuke Tada, Takahiro Matsuzaki, Shunsuke Kotaki and Motoki Sato which claims priority to Japanese Patent Application No. 2010-242061 filed Oct. 28, 2010; and in the names of Takahiro Matsuzaki and Shunsuke Kotaki which claims priority to Japanese Patent Application No. 2010-242060 filed Oct. 28, 2010, which co-pending applications are assigned to the assignee of the instant application and which co-pending applications are also incorporated by reference herein.

BACKGROUND OF THE INVENTION

1. Field of the Invention

The present invention relates to an apparatus for fracturing polycrystalline silicon which is raw material of semiconductor silicon or the like into fragments, and a method for producing fractured fragments of polycrystalline silicon using the apparatus for fracturing.

Priority is claimed on Japanese Patent Application No. 2010-242059, filed Oct. 28, 2010, the content of which is incorporated herein by reference.

2. Description of Related Art

A silicon wafer which is used for a semiconductor chip is manufactured from single-crystal silicon which is produced by, for example, Czochralski method ("CZ method"). For producing single-crystal silicon by the CZ method, for example, fractured fragments of polycrystalline silicon that is obtained by fracturing rod-shaped polycrystalline silicon formed by Siemens process is used.

For fracturing polycrystalline silicon, as shown in FIG. 9, a rod R of polycrystalline silicon is fractured to fragments C of a few millimeters to a few centimeters. In this process, it is typical to break the rod R into appropriate size by thermal shock or the like, and then further hit and break the fragments with a hammer directly. However, the process strains workers, so that it is inefficient to obtain fragments of appropriate size from rod-shaped polycrystalline silicon.

In Japanese Unexamined Patent Application, First Publication No. 2006-122902, a method for obtain silicon fragments by fracturing rod-shaped polycrystalline silicon with a roll-crasher is disclosed. The roll-crasher is a single-roll crasher in which one roll is stored in a housing and a plurality of teeth are formed on a surface of the roll. The roll-crasher fractures the rod-shaped polycrystalline silicon by collapsing between the teeth and an inner surface of the housing so as to impact the polycrystalline silicon continuously.

However, in this apparatus, powder of polycrystalline silicon is apt to be generated since the fractured fragments of silicon are wedged into a gap between roots of the teeth on the roll and the inner surface of the housing and ground. Therefore, fracturing efficiency of silicon to obtain the fragmented silicon of appropriate sizes is deteriorated. Also, the powder cannot be used for the CZ method since particle size is too small. As a result, this apparatus cannot fracture silicon without loss.

On the other hand, in Published Japanese Translation No. 2009-531172 of the PCT International Publication and Japanese Unexamined Patent Application, First Publication No. 2006-192423, apparatuses for fracturing roughly-crashed fragments of polycrystalline silicon are proposed. These apparatuses are double-roll crashers having two rolls and crashing the roughly-crashed fragments of polycrystalline silicon between the rolls.

In these cases, the apparatuses are not efficient since the fragments of polycrystalline are crashed with being ground between the rolls, so that the powder of polycrystalline silicon is apt to be generated.

SUMMARY OF THE INVENTION

Problems to be Solved by the Invention

The present invention is contrived in view of the circumstances, and an object of the present invention is to provide an apparatus for fracturing which is suitable for fracturing polycrystalline silicon and a method for producing fractured fragments of polycrystalline silicon using the apparatus for fracturing, in which polycrystalline silicon can be fractured into fragments of appropriate size, and powder can be prevented from being generated when fracturing so that loss-rate can be reduced.

Means for Solving the Problem

An apparatus for fracturing polycrystalline silicon according to the present invention has: a pair of rolls which are rotated in a counter direction each other around parallel axes; and a plurality of fracturing teeth which are provided on outer peripheral surfaces of the rolls and are protruded radially-outwardly, in which top surfaces thereof are formed spherically and side surfaces thereof are formed conically or cylindrically, and fractures fragments of polycrystalline silicon between the rolls.

In this apparatus for fracturing, polycrystalline silicon can be fractured efficiently by rolling the rolls so that the fracturing teeth strike polycrystalline silicon. The top surfaces of the fracturing teeth are formed spherically, so that the top surfaces of the fracturing teeth and polycrystalline silicon are in contact at points. The side surfaces of the fracturing teeth are formed conically or cylindrically, so that the side surfaces of the fracturing teeth and polycrystalline silicon are in contact in lines. Therefore, since the fracturing teeth and polycrystalline silicon are in contact at points or in lines, polycrystalline silicon can be prevented from being ground into powder by the fracturing teeth.

In the apparatus for fracturing polycrystalline silicon according to the present invention, it is preferable that gaps between the fracturing teeth be in a range of not less than 11 mm and not more than 35 mm, and distance between tips of the fracturing teeth at a facing part of the rolls be in a range of not less than 5 mm and not more than 30 mm.

As described above, polycrystalline silicon can be prevented from being ground since polycrystalline silicon and the fracturing teeth are in contact at points or on line. Furthermore, fragments of appropriate size can be obtained by setting the gaps between the fracturing teeth and the distance between the tips of the fracturing teeth.

In the apparatus for fracturing polycrystalline silicon according to the present invention, it is preferable that the fracturing teeth be formed from cemented carbide or silicon material. By forming the fracturing teeth from cemented carbide or silicon material, the fractured fragments of polycrystalline silicon can be prevented from being contaminated by impurity, so that high-quality polycrystalline silicon as material for semiconductor silicon can be obtained.

A method for producing fractured fragments of polycrystalline silicon according to the present invention products the fractured fragments of polycrystalline silicon by using the apparatus for fracturing polycrystalline silicon described above.

Effects of the Invention

According to the present invention, polycrystalline silicon can be fractured continuously and efficiently by rotating the rolls. Also, since the tops of the fracturing teeth are formed spherically and the side surfaces of the fracturing teeth are formed conically or cylindrically, polycrystalline silicon and the fracturing teeth are in contact at points or in line, so that polycrystalline silicon is not ground. Therefore, the powder can be prevented from being generated, so that the loss rate can be reduced. As a result, the productivity rate can be improved.

DESCRIPTION OF THE PREFERRED EMBODIMENTS

Hereinafter, an embodiment of an apparatus for fracturing polycrystalline silicon according to the present invention and a method for producing fractured fragments of polycrystalline silicon using the apparatus will be described with reference to the drawings.

Figure 1:
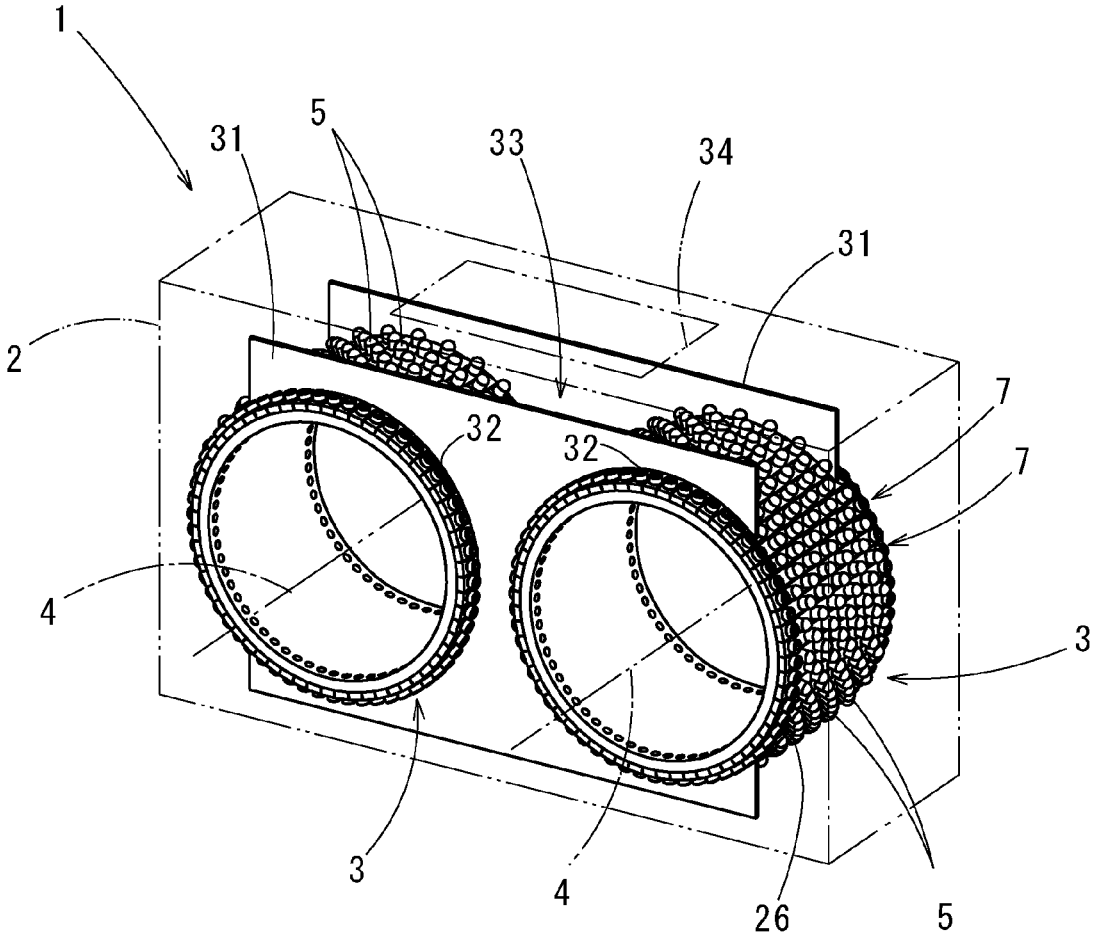
FIG. 1 is a partial perspective view showing an embodiment of an apparatus for fracturing polycrystalline silicon according to the present invention.
Figure 2:
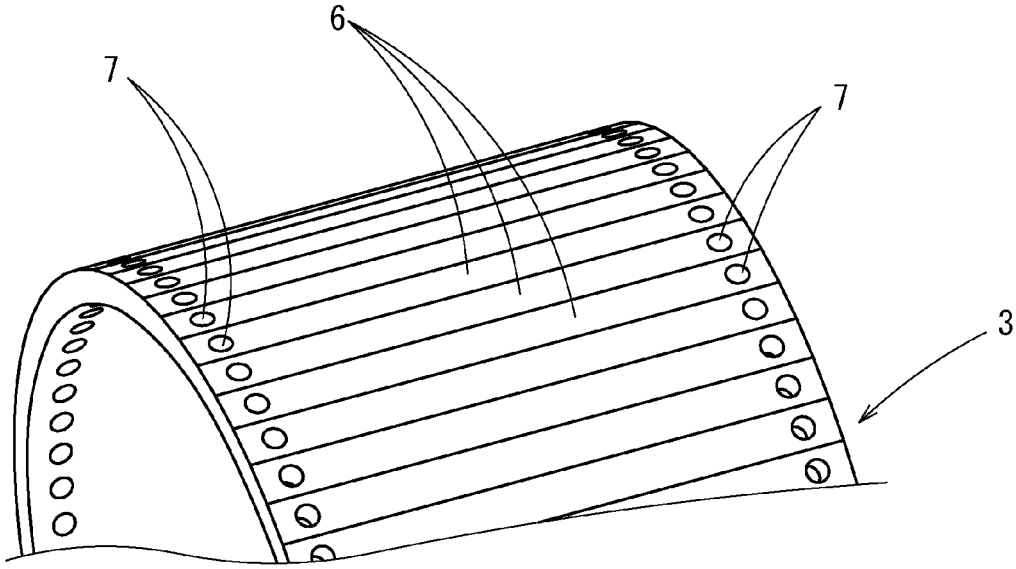
FIG. 2 is a perspective view showing a surface of roll of the apparatus for fracturing shown in FIG. 1.

As shown in FIG. 1, an apparatus 1 for fracturing (hereinafter, "the fracturing apparatus 1") of the present embodiment is provided with two rolls 3 which are arranged in a housing 2 so that axes 4 of the rolls 3 are horizontal and parallel with each other. A plurality of fracturing teeth 5 are provided on an outer peripheral surface of both the rolls 3 so as to protruding radially-outwardly. As shown in FIG. 2, the outer peripheral surfaces of the rolls 3 are not even arc surfaces, but are formed as a polyhedral shape configured from long planes 6 which are elongated along the axis direction and are connected along a circumferential direction. Threaded holes 7 are formed at both ends of the planes 6. On each of the planes 6, a fracturing teeth unit 8 is fixed.

Figure 3:
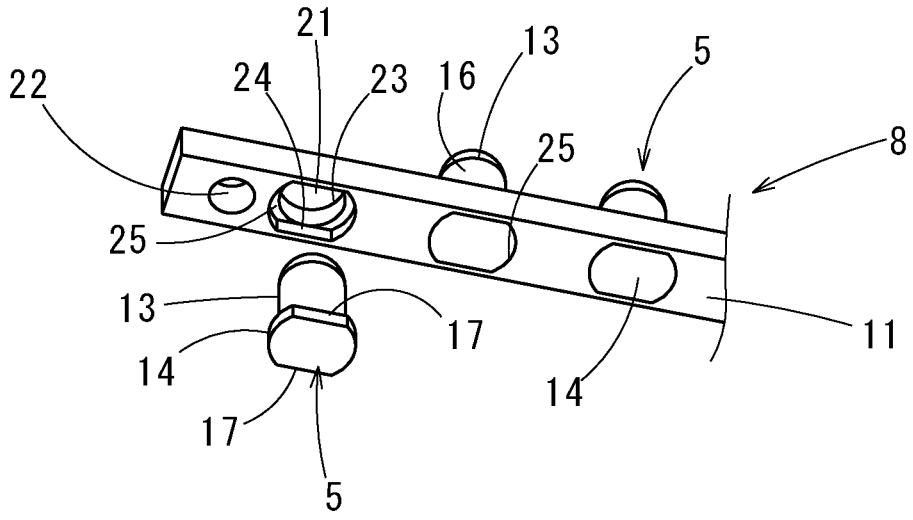
FIG. 3 is a perspective rear view showing a fracturing teeth unit installed in the apparatus for fracturing.
Figure 4:
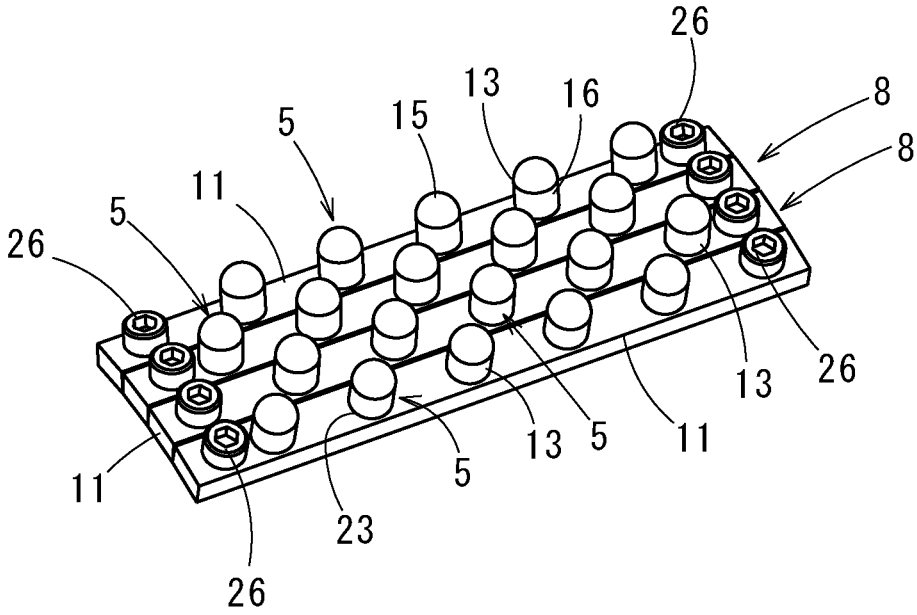
FIG. 4 is a perspective view showing a row of the plurality of the fracturing teeth units.

The fracturing teeth unit 8 is provided with a fixing cover 11 which is in contact with the plane 6 of the roll 3, and the plurality of fracturing teeth 5 which are fixed to the fixing cover 11 as shown in FIG. 3 and FIG. 4.

Figure 5:
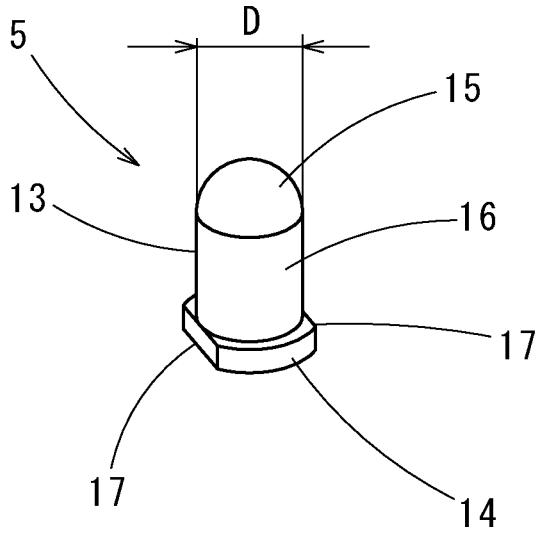
FIG. 5 is a perspective view showing the fracturing tooth.

The fracturing tooth 5 is formed as a unit from cemented carbide or silicon material, and has a column part 13 and a flange 14 which expands in diameter at a base part of the column part 13 as shown in FIG. 5. A top surface 15 of the column part 13 is formed spherically; and a side surface 16 of the column part 13 is formed cylindrically. The flange 14 is formed so that both sides of a circular plate are cut parallel to a longitudinal direction of the column part 13, so that flat parts 17 are formed in 180° opposite direction from each other.

The fixing cover 11 is formed as a strip having a same width and a same length as that of the plane 6 of the roll 3. Fixing holes 21 for fracturing teeth are formed with intervals along a longitudinal direction of the fixing cover 11 so as to penetrate the fixing cover 11. Through-holes 22 for screw are formed at both sides of the fixing cover 11. As shown in FIG. 3, each of the fixing holes 21 is configured with a fit hole 23 and an expanded part 25. The fit hole 23 is formed to a half depth of thickness of the fixing cover 11, and has a circular cross-section corresponding with the side surface 16 of the column part 13 of the fracturing tooth 5. The other half depth of the thickness of the fixing cover 11 of the fixing hole 21 is the expanded part 25 having flat parts 24 corresponding to the flange 14 of the fracturing tooth 5. The fracturing tooth 5 is fixed to the fixing cover 11 so as not to rotate by fitting into the expanded part 25 in a state in which the column part 13 is fitted into the fit hole 23 of the fixing cover 11 and by the flat parts 24 of the fixing cover 11 being in contact with the flat parts 17 of the flange 14.

The fixing cover 11 is laid on each of the planes 6 of the rolls 3 in a state in which the expanded parts 25 face to the surfaces of the rolls 3 and the column parts 13 of the fracturing teeth 5 are protruded from the fit holes 23, and both ends of the fixing cover 11 are fixed to the surfaces of the rolls 3 by screws 26.

Figure 6:
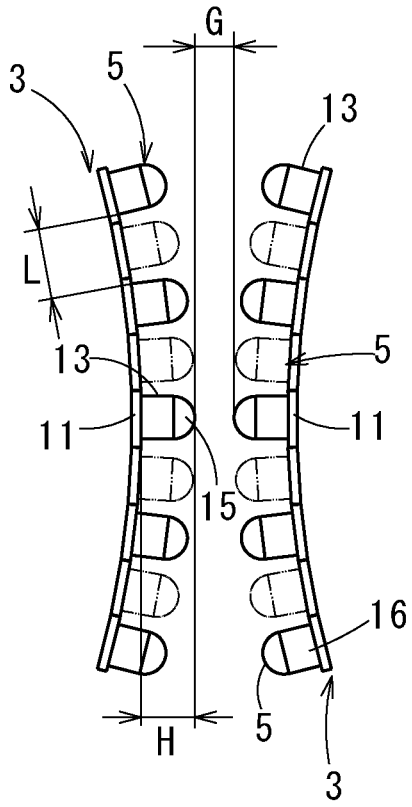
FIG. 6 is a front view showing a positional relation of the rolls at a facing part.

The fracturing teeth units 8 are arranged so that the fracturing teeth 5 of the adjacent fracturing units 8 are not rowed along the circumferential direction of the rolls 3, as shown in FIG. 4. That is, the adjacent fracturing teeth units 8 are installed on the rolls 3 so that the fracturing teeth 5 are arranged in a staggered manner. On the other hand, between the rolls 3, the fracturing teeth 5 are arranged so that the top surfaces 15 of the fracturing teeth 5 on the rolls 3 face each other at the facing part as shown in FIG. 6. In FIG. 6, among the staggered fracturing teeth 5, the fracturing teeth 5 arranged in a same circumferential row are denoted by continuous lines; and the fracturing teeth 5 arranged in the other circumferential row are denoted by two-dot lines.

In this embodiment, target size of fragments of polycrystalline silicon after fracturing (i.e., fractured fragments of polycrystalline silicon) is set in a range of 5 mm to 60 mm in maximum length. In order to obtain the fragments of such size: a diameter D of the column part 13 of the fracturing tooth 5 is set in a range of 10 mm to 14 mm; a protruding height H of the fracturing tooth 5 from the surface of the fixing cover 11 to the tip of the fracturing tooth 5 shown in FIG. 6 is set in a range of 10 mm to 30 mm; and a gap L between the adjacent fracturing tooth 5 is set in a range of 11 mm to 35 mm. Also, at the facing part of the rolls 3, a facing distance G between the top surfaces 15 of the fracturing teeth 5 is set in a range of 5 mm to 30 mm.

The housing 2 in which the rolls 3 are set is formed of resin such as polypropylene or the like, or formed of metal having an inner coating of tetrafluoroethylene in order to prevent contamination.

In the housing 2, a pair of partition plates 31 which cross the axes 4 of the rolls 3 are provided at both ends of the rolls 3 with certain intervals with respect to the inner wall surface of the housing 2 so as to be parallel with the inner wall surface of the housing 2. The partition plates 31 are fixed to the housing 2, have two cutouts 32 which are formed by being cut at circular arc shape with slightly larger diameter than that of the rolls 3 so as to engage the half or more of the rolls 3, and are arranged with spanning the rolls 3 in a state in which the cutouts 32 are engaged to the ends of the rolls 3.

In a state in which the partition plates 31 are engaged to the rolls 3, gaps are formed between inner peripheral surfaces of the cutouts 32 of the partition plates 31 and outer peripheral surfaces of the rolls 3 so as not to disturb the rotation of the rolls 3. Also, the screws 26 for fixing the fracturing teeth units 8 which are provided at both the ends of the rolls 3 are positioned outside the partition plates 31 so that spaces above and below the facing part of the rolls 3 are located between the partition plates 31. The space between the partition plates 31 is a fracturing space 33 for polycrystalline silicon. On an upper surface of the housing 2, an inlet 34 is formed so as to be arranged immediately above the fracturing space 33. The partition plates 31 are formed from resin such as polypropylene or the like or metal having inner coating of tetrafluoroethylene, as the housing 2.

The housing 2 is provided with a gearbox or the like (not shown) for rotary-driving the rolls 3. The gearbox is connected to an exhaust system (not shown) so as to exhaust the housing 2 and an inner space of the gearbox.

When fractured fragments of polycrystalline silicon is produced by using the fracturing apparatus 1 configured as described above, in a state of rolling the rolls 3, by supplying roughly-fractured polycrystalline silicon of appropriate size into the fracturing space 33 for polycrystalline silicon between the partition plates 31 through the inlet 34 of the housing 2, the fragments of polycrystalline silicon are further fractured into fragments between the fracturing teeth 5 of the rolls 3.

In the fracturing teeth 5, the top surfaces 15 are formed spherically, so that the top surfaces 15 and polycrystalline silicon are in contact at points. Also, in the fracturing teeth 5, the side surfaces 16 of the column parts 13 are formed cylindrically, so that the side surfaces 16 and polycrystalline silicon are in contact at points or in lines. Therefore, the fracturing teeth 5 impact polycrystalline silicon in a state of being in contact with polycrystalline silicon at points or in lines, so that polycrystalline silicon can be prevented from being crushed by planes.

The partition plates 31 which are arranged above the ends of the rolls 3 prevent the fragments of polycrystalline silicon which are fractured therebetween from being ground by entering between the inner wall surfaces of the housing 2 and the end surfaces of the rolls 3. Therefore, the fragments of polycrystalline silicon can be reliably fractured and pass through between the rolls 3.

As a result, in the fracturing apparatus 1, polycrystalline silicon can be fractured to of desired size, so that the powder can be prevented from being generated and the loss rate can be reduced.

Figure 7A:
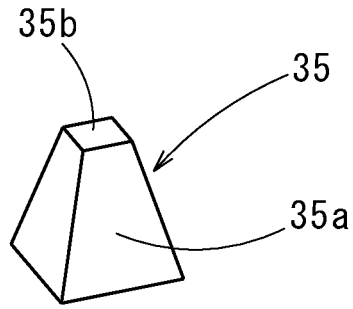
FIG. 7A is a perspective view showing truncated pyramid-shape fracturing teeth.
Figure 7B:
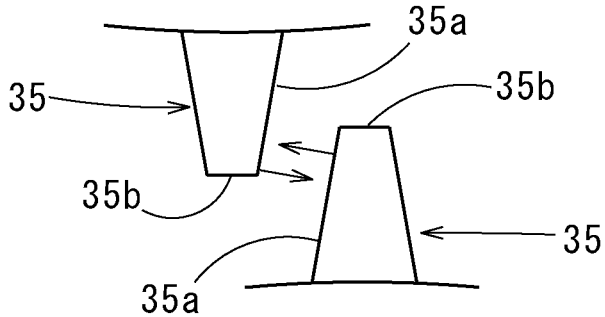
FIG. 7B is a front view showing the truncated pyramid-shape fracturing teeth at the facing part of the rolls.

Incidentally, if fracturing teeth 35 were formed into truncated pyramid-shape as shown in FIG. 7A, there is a case in which polycrystalline silicon is wedged between flat parts 35*a* of the fracturing teeth 35 and crushed, so that powder is generated owing to surface-contact as shown in FIG. 7B. In the comparative example shown in FIG. 7A and FIG. 7B, since top surfaces 35*b* of the fracturing teeth 35 are also formed into flat planes, polycrystalline silicon is ground also by the top surfaces 35*b*.

It is difficult to prevent generating of powder when using the fracturing teeth having flat planes. On the other hand, in the fracturing teeth according to the present invention, the top of the column part is formed spherically and the side surface of the column part is formed cylindrically, so that the powder can be reduced.

Furthermore, in the fracturing apparatus 1, since the fracturing teeth 5 are formed from cemented carbide or silicon material, impurities are prevented from contaminating polycrystalline silicon from the fracturing teeth 5. Although the screws 26 which fix the fracturing teeth units 8 are generally made of metal, the screws 26 are not in contact with polycrystalline silicon since the screws 26 are arranged outside the fracturing space 33 for polycrystalline silicon. Furthermore, the partition plates 31 and the housing 2 surrounding the fracturing space 33 for polycrystalline silicon are made from resin such as polypropylene or the like, or are coated by tetrafluoroethylene. Therefore, polycrystalline silicon can be prevented from being contaminated by impurities while fracturing. As a result, according to the fracturing apparatus 1, high-quality polycrystalline silicon for semiconductor material can be obtained.

Furthermore, in the present embodiment, the fracturing teeth units 8 in which the fixing cover 11 holds the fracturing teeth 5 independently with each other are fixed on the surface of the rolls 3. Therefore, when some fracturing teeth 5 are fallen or chip away, it is sufficient to replace the defective fracturing teeth 5. In this case, since the fracturing teeth units 8 are fixed to the rolls 3 by the screws 26 and the fracturing teeth 5 are only fitted into the fixing holes 21 for fracturing teeth of the fixing cover 11, it is easy to replace the fracturing teeth 5. It is preferable that the fixing cover 11 be made of stainless steel or the like in order to maintain strength. Moreover, it is preferable that the surface of the fixing cover 11 be coated with resin such as polypropylene, tetrafluoroethylene, or the like in order to prevent contamination even if polycrystalline silicon is in contact with the fixing cover 11.

Figure 8A:
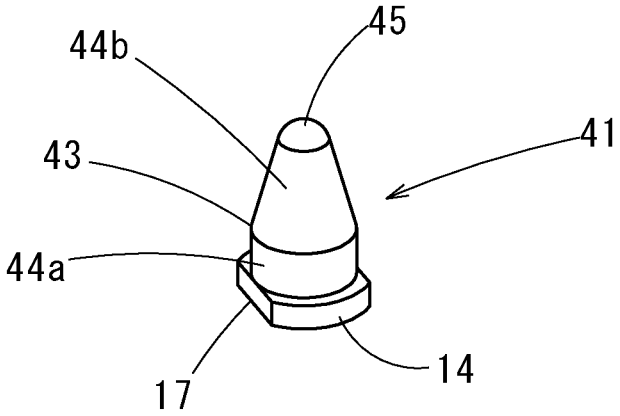
FIGS. 8A and 8B are perspective views showing two kind of modified examples of the fracturing teeth.
Figure 8B:
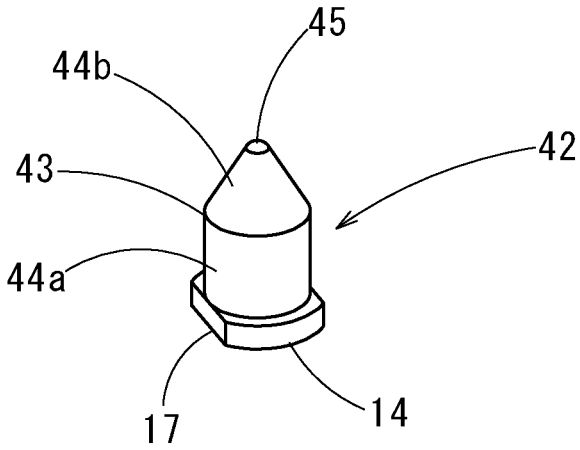
Figure 9:
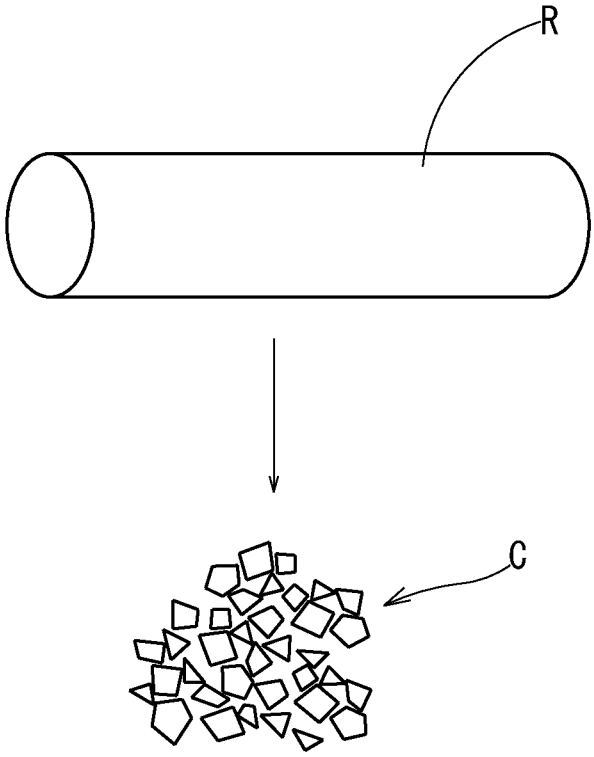
FIG. 9 is a schematic view showing fragments obtained by fracturing a rod of polycrystalline silicon.

FIGS. 8A and 8B show modified examples of the fracturing teeth for the fracturing apparatus 1 according to the present invention. The fracturing teeth 41 and 42 each have a column part 43 and a flange 14 as the fracturing teeth 5 of the first embodiment. The shape of the flange 14 is the same as shown in FIG. 5. The same parts as that of the first embodiment are denoted by the same reference symbols in these drawings.

The fracturing tooth 41 shown in FIG. 8A has: a column part 43 in which a side surface 44*a* having a cylindrical-shape is formed from the flange 14 to a middle part along a longitudinal direction, and a side surface 44*b* having a conical-shape is formed from the middle part to a top portion; and a top surface 45 having spherical-shape. A length of the cylindrical-shaped side surface 44*a* is not more than a half length of the column part 43. The conical-shaped side surface 44*b* is formed longer than the cylindrical-shaped side surface 44*a*.

In the fracturing tooth 42 shown in FIG. 8B, the cylindrical-shaped side surface 44*a* of the column part 43 is formed so as to be longer than the side surface 44*a* of the fracturing tooth 41 shown in FIG. 8A and have a length not less than a half length of the column part 43. Therefore, the conical-shaped side surface 44*b* of the fracturing tooth 42 is formed to be shorter than the side surface 44*b* of the fracturing tooth 41.

The present invention is not limited to the above-described embodiments and various modifications may be made without departing from the scope of the present invention.

For example, the top surfaces of the fracturing teeth are faced each other at the facing part of the rolls in the above embodiment. However, the fracturing teeth of one roll may be arranged so as to be faced to gaps between the fracturing teeth of the other roll.

Also, dimensions of the facing gaps or the like of the fracturing teeth are not limited to the above-described embodiments.

What is claimed is:

1. An apparatus for fracturing polycrystalline silicon comprising:

a pair of rolls which are rotated in a counter direction each other around parallel axes; and a plurality of fracturing teeth which are provided on outer peripheral surfaces of the rolls and are protruded outwardly along radial direction of the rolls, in which top surfaces thereof are formed semi-spherically and side surfaces thereof are formed conically or cylindrically, the apparatus fracturing fragments of polycrystalline silicon between the rolls.

2. The apparatus for fracturing polycrystalline silicon according to claim 1, wherein gaps between the fracturing teeth are in a range of not less than 11 mm and not more than 35 mm, and distance between tips of the fracturing teeth at a facing part of the rolls is in a range of not less than 5 mm and not more than 30 mm.

3. The apparatus for fracturing polycrystalline silicon according to claim 1, wherein the fracturing teeth are formed from cemented carbide or silicon material.

4. A method for producing fractured fragments of polycrystalline silicon using the apparatus for fracturing polycrystalline silicon according to claim 1.

5. The apparatus for fracturing polycrystalline silicon according to claim 1, wherein the plurality of fracturing teeth are provided with a fixing cover which is in contact with a plane of the roll, and are fixed to the fixing cover.

6. The apparatus for fracturing polycrystalline silicon according to claim 5, wherein the plurality of fracturing teeth are arranged in a staggered manner.

* * * * *